US005114139A

United States Patent [19]

Kodama

[11] Patent Number: 5,114,139

[45] Date of Patent: May 19, 1992

[54] IMAGE-FORMING APPARATUS PROVIDED WITH AUTOMATIC ORIGINAL DELIVERY MECHANISM AND CARRIER SHEET FOR USE IN SAID APPARATUS

[75] Inventor: Kiyofumi Kodama, Osaka, Japan

[73] Assignee: Mita Industrial Co., Ltd., Osaka, Japan

[21] Appl. No.: 437,689

[22] Filed: Nov. 17, 1989

[30] Foreign Application Priority Data

Nov. 18, 1988 [JP] Japan ..... 63-151354[U]
Nov. 30, 1988 [JP] Japan ..... 63-300865

[51] Int. Cl.[5] ..... B65H 7/02

[52] U.S. Cl. ..... 271/265; 355/75; 271/176

[58] Field of Search ..... 355/230, 75, 133, 201; 271/265, 259, 263, 176

[56] References Cited

U.S. PATENT DOCUMENTS 3,746,445 7/1973 Bobbitt ..... 355/75 X
3,814,518 6/1974 Wichers ..... 355/75

FOREIGN PATENT DOCUMENTS 55637 3/1987 Japan ..... 355/75

*Primary Examiner*—Richard A. Schacher

*Attorney, Agent, or Firm*—H. Jay Spiegel

[57] ABSTRACT

The present invention relates to an image-forming apparatus provided with an automatic original delivery mechanism, in which an original set at an insertion opening is automatically received and guided to a copying position by an automatic original delivery device and after the copying operation, the original is discharged to the outside of the appartus. This automatic original delivery device is controlled by a copying paper sheet delivery trouble detector so that the reverse delivery of the original can be performed by the automatic original delivery device. In this apparatus, if a delivery trouble of a copying paper sheet is caused, the inserted original is returned to the initial setting position by this reverse delivery, and the operation of setting the original at the initial setting position again can be omitted. If an original formed of a very thin paper or very thin sheet is used in this image-forming apparatus, an original carrier sheet is used for the copying operation so as to prevent the original from being damaged. In the present invention, an original carrier sheet having a specific notch formed in a connecting portion of two sheet portion of the carrier sheet is used, and improper setting of the original can be prevented by this original carrier sheet.

4 Claims, 5 Drawing Sheets

Fig. 4-A
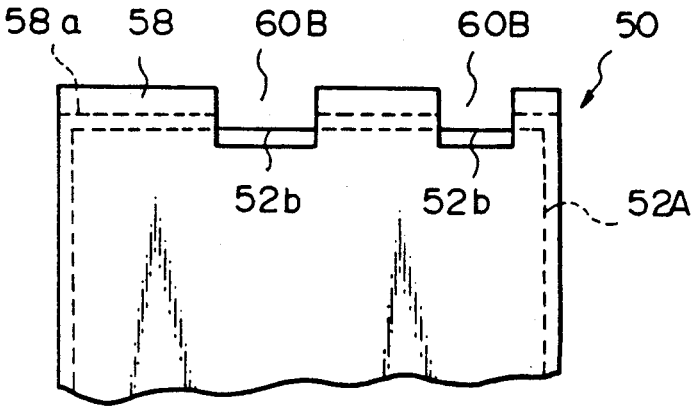
Fig. 4-B
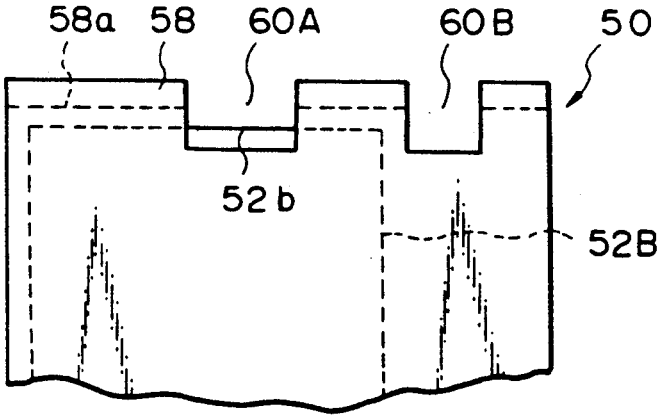

IMAGE-FORMING APPARATUS PROVIDED WITH AUTOMATIC ORIGINAL DELIVERY MECHANISM AND CARRIER SHEET FOR USE IN SAID APPARATUS

BACKGROUND OF THE INVENTION (1) Field of the Invention

The present invention relates to an image-forming apparatus provided with an automatic original delivery mechanism. More particularly, the present invention relates to an image-forming apparatus provided with an automatic original delivery mechanism having automatic original delivery means for automatically receiving and guiding an original set at an insertion opening to a copying position and discharging the original to the outside of the apparatus after the copying operation, in which the disposal of the original is facilitated when jamming or other delivery trouble of a copying paper sheet takes place.

Furthermore, the present invention relates to an original carrier sheet for carrying out the copying operation without damaging an original composed of a very thin paper or very thin sheet. More particularly, the present invention relates to an original carrier sheet which is applied to an image-forming apparatus provided with an automatic original delivery mechanism to prevent improper setting of an original.

(2) Description of the Related Art

Image-forming apparatus include a printer, a facsimile device, a copying machine and the like. An automatic original delivery mechanism of such an image-forming apparatus, for example, a copying machine, comprises a delivery device ordinarily arranged at the copying position and an original detector for detecting the original feeding timing or detecting the presence or absence of an original. The operation timing of the driving system for the original delivery device is generally the same as or synchronous with that of the driving system for a photosensitive drum and a copying paper sheet (paper sheet on which a copied image is formed), and the timing of feeding the original synchronously with the copying paper sheet is set by the original detector.

If a delivery trouble such as jamming is caused in the delivery of the copying paper sheet in the copying machine, the machine is stopped and after the jamming-removing treatment, that is, after the normal state has been restored, the copying operation is started again.

In the conventional copying machine, if jamming is caused, a copying paper sheet should be taken out of the apparatus and furthermore, an original should be taken out of the automatic delivery mechanism and be placed at the initial setting position again. This operation is very troublesome.

For eliminating the troublesome operation of taking the original out of the automatic original delivery mechanism, there has been proposed a copying machine capable of automatically discharging an original from the automatic original delivery mechanism when jamming or the like occurs (see Japanese Unexamined Patent Publication No. 55-156966 and Japanese Unexamined Patent Publication No. 59-106099). Even in the copying apparatus having the above-mentioned structure, a troublesome operation of resetting the original at the initial setting position cannot be eliminated.

This resetting of the original should be performed not only at jamming of a copying paper sheet but also at jamming of the original per se.

Not only ordinary document originals but also very thin paper originals, very thin sheet originals, small-size sheet originals and sheets originals having a special shape are used in the image-forming apparatus provided with the automatic original delivery mechanism, and in case of a special original as mentioned above, the copying operation is carried out through an original carrier sheet. As shown in FIG. 5, a conventional original carrier sheet 70 comprises a pair of sheet portions 72 and 74 having insertion top end sides thereof bonded together by a connecting portion 76. The sheet portion 72 is transparent and the copying face of a very thin original 78 supported confronts the sheet portion 72. In view of the bonding strength and the flexural elasticity, the connecting portion 76 of the conventional original carrier sheet 70 is formed to have a certain width and the top end side of the original 78 abuts on the bonding line (broken line 80 in FIG. 5).

When the original is delivered by using the original carrier sheet, an original-detecting switch of the delivery mechanism does not detect the top end of the original but the top end of the carrier sheet 70, and therefore, reading is not effected from the predetermined position of the original and there is a risk of dislocation of the image-forming position.

Of course, this dislocation or shear of the image-forming position is caused by the fact that it is not the top end of the original but the top end of the carrier sheet that is detected for the reading, and this dislocation can be prevented by staggering the reading time by the depth (length in the delivery direction) of the connecting portion between both the sheet portions in the carrier sheet. However, a changeover switch and a control device become necessary for this adjustment, with the result that the cost increases and the operation becomes complicated.

Furthermore, in the case where the above-mentioned original carrier sheet is used, even if the reading time can be staggered, it seldom happens that the top end side of the original abuts exactly to the connecting portion between both the sheet portions, and therefore, it is difficult to solve the problem of dislocation of the image-forming position.

SUMMARY OF THE INVENTION

The present invention has been completed under the above-mentioned background. It is therefore a primary object of the present invention to provide an image-forming apparatus provided with an automatic original delivery mechanism, in which after jamming of a copying paper sheet or the like occurs, an original can be automatically set at the initial setting position without taking out the original from the automatic original delivery mechanism.

Another object of the present invention is to provide an image-forming apparatus provided with an automatic original delivery mechanism, in which when a delivery trouble of an original is caused, the original can be automatically set at the initial setting position.

In accordance with one fundamental aspect of the present invention, the foregoing objects can be attained by providing an image-forming apparatus provided with an automatic original delivery mechanism for automatically receiving and guiding an original set at an insertion opening to a copying position by automatic original delivery means and discharging the original to the outside of the apparatus after the copying operation, said apparatus comprising first original detecting means arranged at the initial setting position of the original, second original detecting means for detecting the absence or presence of the original in the course of from the original insertion opening to the original discharge opening, including the copying position, copying paper sheet delivery trouble detecting means arranged in a delivery path for a copying paper sheet to detect a delivery trouble of the copying paper sheet, and original delivery means capable of delivering the original from the original insertion opening to the discharge opening and performing the reverse delivery of the original, said original delivery means being controlled by said first original detecting means, second detecting means and said copying paper sheet delivery trouble detecting means so that in the state where said second original detecting means detects the original and the copying paper sheet delivery trouble detecting means detects a delivery trouble of the copying paper sheet, said original delivery means is actuated to perform the reverse delivery, and in the state where no trouble occurs in the copying paper sheet delivery path and said first original detecting means detects the original, said original delivery means is actuated to perform the normal delivery.

According to one preferred embodiment of the apparatus of the above-mentioned fundamental aspect, the timing of discharging the original by said original delivery means is substantially the same as the timing of discharging the copying paper sheet.

According to another preferred embodiment of the apparatus of the above-mentioned fundamental aspect, a delivery trouble of the original is detected by said second original detecting means and said original delivery means is controlled based on the detection of said delivery trouble to perform the reverse delivery of the original.

A still another object of the present invention is to provide an original carrier sheet capable of preventing dislocation of an image-forming position of an original inserted in the carrier sheet.

In accordance with another fundamental aspect of the present invention, this still another object can be attained by providing an original carrier sheet comprising two sheets, at least one of which is transparent, said two sheets being connected on at least one end sides thereof, said original carrier sheet being set in an image-forming apparatus provided with an automatic original delivery mechanism in the state where an original is arranged between said two sheets of the original carrier sheet, wherein a notch is formed to extend from the top end in the delivery direction of the carrier sheet in the connecting portion of the two sheets so that the top end in the delivery direction of the original arranged between the two sheets is detected by the image-forming apparatus.

According to this aspect of the present invention, by forming a specific notch extending from the top end in the delivery direction of the carrier sheet beyond the connecting portion of the two sheets by a certain depth, the top end in the delivery direction of the original per se gripped between the two sheets can be detected by the image-forming apparatus, and therefore, reading of the original starts at the predetermined position of the original and dislocation of the image-forming position can be prevented.

BRIEF DESCRIPTION OF THE DRAWINGS

FIGS. 4-A and 4-B are plan views showing another example of the original carrier sheet of the present invention.

DETAILED DESCRIPTION OF THE PREFERRED EMBODIMENTS

Figure 1:
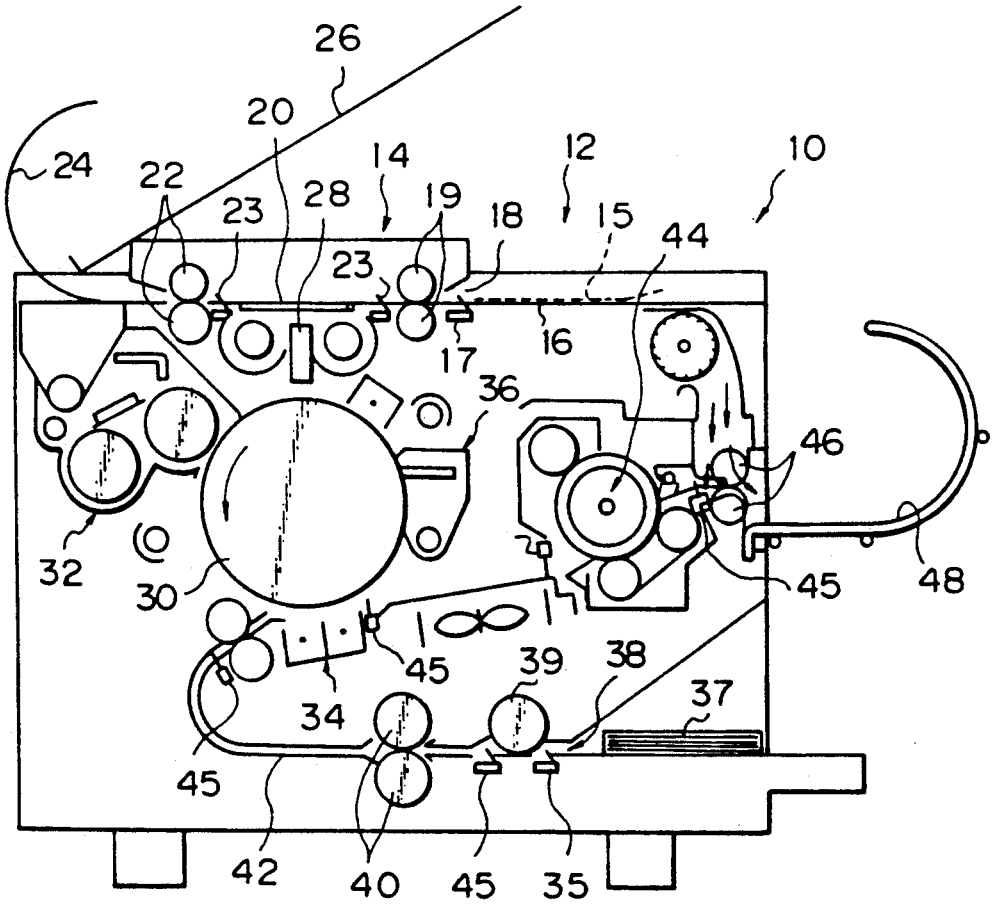
FIG. 1 is a diagram illustrating a copying apparatus to which the automatic original delivery mechanism of the present invention is attached.

In the image-forming apparatus provided with the automatic original delivery mechanism according to the present invention, an original is placed on a paper feed tray or the like and set at an initial setting position. Synchronously with the timing of insertion of a copying paper sheet (paper sheet on which a copied image is formed), the original is fed to the copying position from an insertion opening by original delivery means based on the detecting action of first detecting means. The original is once stopped at the copying position, and after the copying operation, the original is discharged from a discharge opening by the original delivery means.

The second original detecting means inspects the movement of the original from the insertion opening to the discharge opening to detect whether the original has been precisely reproduced.

In the above-mentioned construction, if a delivery trouble of a copying paper sheet is caused in a copying paper sheet path during the copying operation, this delivery trouble is detected by the copying paper sheet delivery trouble detecting means. The copying machine is once stopped based on this detection and the treatment for obviating this delivery trouble is performed. After this treatment, the copying machine is started again, and when the second original detecting means detects the presence of the original in the original delivery means, the driving system for the original delivery means is reversed to effect the reverse delivery of the original.

In the foregoing description, the reverse delivery operation by the original delivery means is performed after the copying machine has once been stopped. In this case, however, there may be adopted a method in which just after detection of a delivery trouble, the reverse delivery by the original delivery means is performed before the stoppage of the copying machine.

The original is returned to the initial setting position by this reverse delivery of the original, and when the original is detected by the first original detecting means, the reverse delivery of the original is stopped. If the copying paper sheet delivery line is in the normal state, the copying operation is started again.

In the apparatus of the present invention, as is apparent from the foregoing description, even if a delivery trouble (jamming) of a copying paper sheet is caused, the original is automatically reset.

If the timing of discharging the original by the original delivery means is made equal to the timing of discharging the copying paper sheet, when a delivery trouble (jamming) of the copying paper sheet is caused in the delivery line, the original is assuredly returned by the delivery means. Namely, in this case, the delivery trouble of the copying paper sheet takes place while the original is within the original delivery means.

In the case where a delivery trouble (jamming) of the original is caused by influences of the original delivery means or the like even if the timing of insertion of the original is made synchronous with the timing of insertion of the copying paper sheet by the first original detecting means, according to one preferred embodiment of the present invention, the delivery trouble of the original is detected by the second original detecting means.

Based on the detection of the delivery trouble by the second original detecting means, the original delivery means is actuated to perform the reverse delivery of the original.

The automatic original delivery mechanism of the present invention will now be described with reference to preferred embodiments illustrated in the accompanying drawings.

FIG. 1 is a diagram illustrating a copying machine to which the automatic original delivery mechanism of the present invention is attached. The copying machine 10 shown in FIG. 1 will now be described in brief. An original-inserting zone 12 and an original automatic feed device 14 are arranged on the top face of the copying machine 10. An original 15 is placed on an original setting stand 16 mounted on the right upper face of the copying machine 10 and is delivered into the original automatic feed device 14 from an insertion opening 18 by delivery rollers 19.

A first original detector 17 is arranged in the vicinity of the insertion opening 18 and is related to a paper detector 35, described hereinafter, of a paper feed opening 38 for a copying paper sheet 37, and the timing of insertion of the original 15 is made synchronous with the timing of insertion of the copying paper sheet 37.

A second original detector 23 is disposed in the original automatic feed device 14 to detect the movement of the original 15 in the device 14. The second original detector 23 controls delivery rollers 19 and feed rollers 23 as the delivery means for the original automatic feed device 14 based on the detection of the original 15. Accordingly, the original 15 is copied at the copying position 20 while being detected by the second original detector 23 and is then fed out by the feed rollers 22. The original 15 thus fed out is fed to a semi-spherical cover 24 and loaded on a receiving tray 26.

The delivery roller 19 and feed roller 22 are capable of not only normally rotating in the delivery direction but also reversely rotating. This reverse rotation is effected based on the detection by the second original detector 23. The second original detector 23 emits a control signal for the reverse rotation of the delivery roller 19 and feed roller 22 when the copying machine 10 is stopped by jamming of the copying paper sheet or the like and is then operated and the second original detector 23 detects the original 15. Furthermore, when the second original detector 23 detects the error of the delivery timing of the original 15 (at the time of jamming of the original), a control signal for the reverse rotation is emitted to the delivery roller 19 and feed roller 22. Incidentally, a delivery belt can be used instead of the delivery roller 19 and feed roller 22.

A light exposure zone 28 having an optical system is arranged below the copying position 20, and a drum 30 having an amorphous silicon type photoconductive layer formed on the surface thereof is arranged below the light exposure zone. A charging zone is constructed by this drum 30. A developing zone 32 for supplying a toner or the like, a transfer zone 34 for transferring an image onto the copying paper sheet and an electricity-removing and cleaning zone 36 are arranged on the periphery of the drum 30.

The copying paper sheet 37 is fed from the paper feed opening 38 located in the lower portion of the copying machine 10, and a timing roller 39 and the above-mentioned copying paper sheet detector 35 are arranged on the paper feed opening 38. Synchronously with the timing of insertion of the original 15, the copying paper sheet 37 is fed to the transfer zone 34 through resist rollers 40 and a guide path 42. An image is transferred onto the copying paper sheet in the transfer zone 34 and the copying paper sheet is then fed to a fixing zone 44 to fix the image by heating or under application of pressure.

A plurality of jamming detectors 45 are arranged in this delivery path for the copying paper sheet 37. The jamming detector 45 detects a delivery trouble of the copying paper sheet and stops the copying machine 10. The jamming detector 45 can detect the delivery trouble by sliding contact with the copying paper sheet 37 or based on the change of a load on a nip roller or the like. Furthermore, an ordinary paper jamming detector can be used.

The copying paper sheet 37 is fed out by nip rollers 46 and conveyed to a curved tray 48.

In the automatic original delivery mechanism of the present invention having the above-mentioned structure, the original 15 is placed on the original setting stand 16 and is set at the initial setting position.

The original 15 is inserted from the insertion opening 18 synchronously with the insertion timing of the copying paper sheet 35 based on the first original detector 17. The original 15 in the original automatic feed device 14 is fed to the copying position 20 by the delivery rollers 19. The original is copied at the copying position 20 after it has been once stopped or while it is being moved. After the copying operation, the original 15 is fed out from the original automatic feed device 14 by the feed rollers 22.

When a delivery trouble of the copying paper sheet 35 is caused in the delivery path for the copying paper sheet 35 at the above-mentioned copying operation, this delivery trouble is detected by the jamming detector 45. Based on this detection, the copying machine 10 is once stopped and a treatment for obviating the trouble is carried out. After this treatment, the copying machine 10 is worked again, and in the case where the second original detector 23 detects the original 15, a control signal for reversely rotating the delivery rollers 19 is emitted from the second original detector 23. By this signal, the delivery rollers 19 are reversely rotated to effect the reverse delivery of the original 15.

By the reverse delivery of the original 15, the original is returned to the initial setting position on the original setting stand 16. After the lapse of a certain time from the point when the first original detector 17 then detects the return end of the original 15, the reverse delivery of the original 15 is stopped, and the copying operation of the original 15 is started again. Incidentally, the reverse delivery of the original 15 may be stopped after the lapse of a certain time from the point when the second original detector located at the original insertion opening ceases to detect the original.

As is apparent from the foregoing description, even if a delivery trouble (jamming) of the copying paper sheet 35 is caused, the original can be automatically reset. Accordingly, the operation of opening and closing the original automatic feed device 14 for taking out the original 15 and the operation of setting the original 15 again become unnecessary.

In the foregoing embodiment, the reverse delivery of the original 15 by the delivery roller 19 and feed roller 22 is carried out after the copying machine 10 has been once stopped. However, there can be adopted a modification in which when a delivery trouble is detected, the reverse delivery is immediately carried out before the stoppage of the copying machine 10. Accordingly, the delivery roller 19 and feed roller 22 of the original automatic feed device 14 are reversely rotated indirectly or directly when the jam detector 45 detects a delivery trouble of the copying paper sheet 35 and the second original detector 23 detects the original 15.

If the timing of discharge of the original 15 from the original automatic feed device 14 is made substantially equal to the timing of discharge of the copying paper sheet 35, when a delivery trouble (jamming) of the copying paper sheet 35 is caused, the original 15 can be returned from the original automatic feed device 14 assuredly. This means that if a delivery trouble of the copying paper sheet 35 is caused while the original 15 is present in the original automatic feed device 14, the original 15 is returned to the initial setting position without fail. Accordingly, misplacement of the original or missing of the original can be prevented.

In the copying machine 10 of the present invention having the above-mentioned structure, even when a delivery trouble of the original 15 is caused, automatic setting of the original 15 is possible.

More specifically, in the case where the delivery speed is put out of order by the delivery roller 19 or the like in the original automatic feed device 14 even if the timing of insertion of the original 15 is made synchronous with the timing of insertion of the copying paper sheet 35 by the first original detector 17, a delivery trouble of the original 15 is caused. When this delivery trouble (jamming) of the original 15 is caused, the second original detector 23 detects the delivery trouble of the original 15. Based on the detection of the delivery trouble by the second original detector 23, the reverse delivery of the original is performed by the delivery roller 19 and feed roller 22. By this reverse delivery of the original 15, the original 15 is returned to the initial setting position.

Incidentally, the first original detector 17 and second original detector 23 may be of the contact type as shown in FIG. 1, but other known detectors such as optical sensors and ultrasonic sensors can be used.

In the foregoing embodiment, the second original detector 23 is disposed to detect jamming of the original based on the delivery timing of the original, but there can be adopted a modification in which a plurality of detectors 23 are disposed at different positions to detect dislocation owing to inclination of the original as well as the above jamming.

As is apparent from the foregoing description, in the image-forming apparatus provided with the automatic original delivery mechanism according to the present invention, original delivery means capable of delivering an original in the reverse direction is attached to the copying machine, and when a delivery trouble of a copying paper sheet is detected and the original is detected by second original detecting means disposed in the original delivery means, the original delivery means is operated to perform the reverse delivery. Accordingly, after occurrence of a delivery trouble of a copying paper sheet, it is not necessary to take out an original from the automatic original delivery mechanism. Furthermore, this original can be automatically set at the initial setting position by the first original detecting means.

Moreover, in the present invention, since a delivery trouble of an original is detected by the second original detecting means and based on this detection of the delivery trouble, the reverse delivery of the original is performed, the original can be automatically set at the initial setting position even on occurrence of a delivery trouble of the original.

An original carrier sheet to be applied to the image-forming apparatus provided with the original delivery mechanism described hereinbefore will now be explained with reference to FIGS. 2 and 3.

Figure 2:
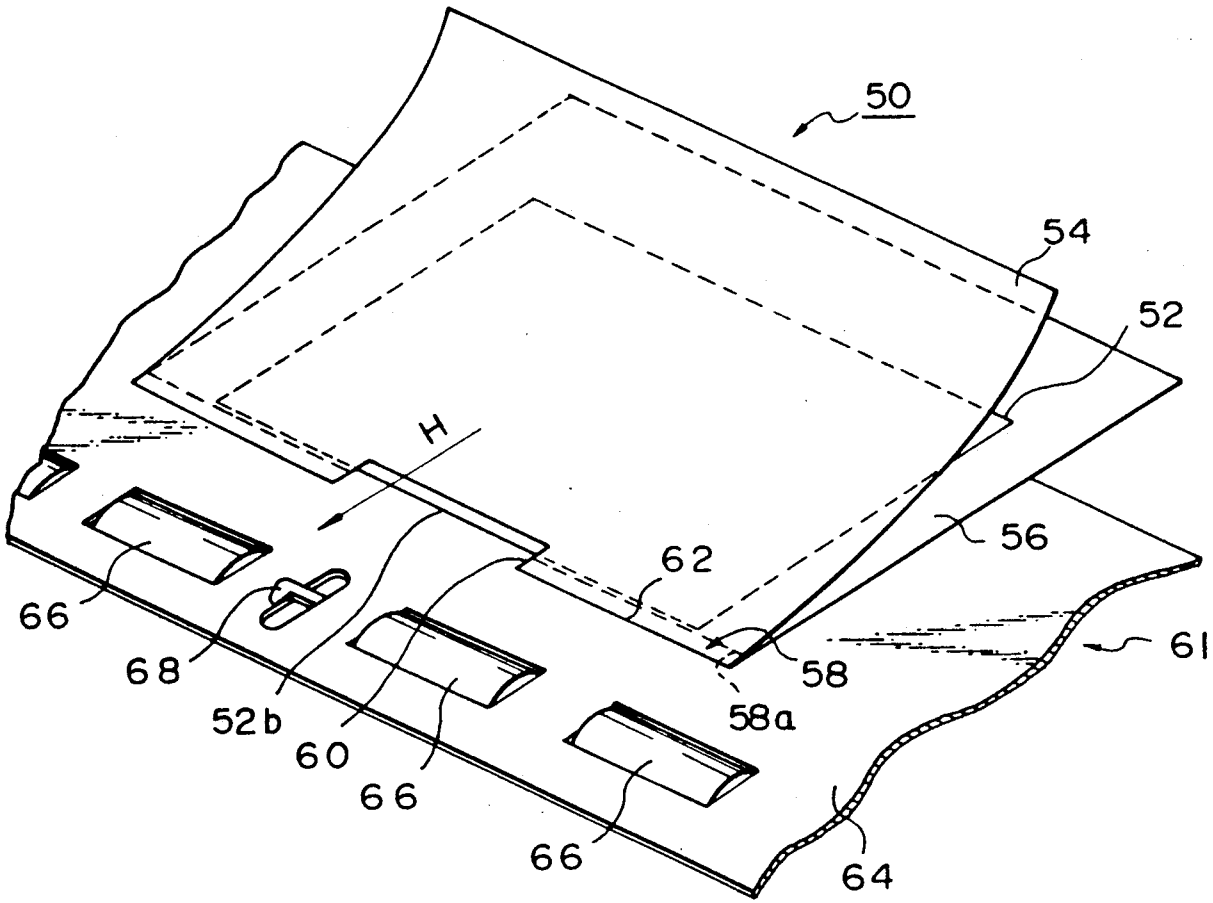
FIG. 2 is a perspective view illustrating the state of use of an embodiment of the original carrier sheet of the present invention.
Figure 3:
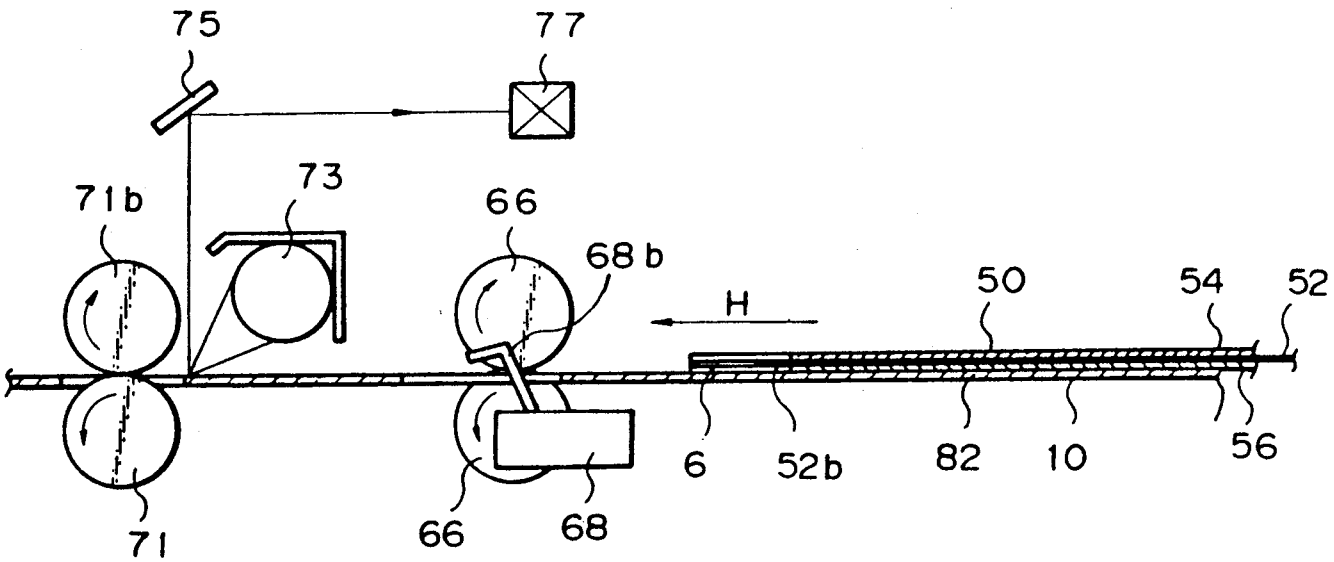
FIG. 3 is a longitudinal view showing the state of use of the original carrier sheet.
Figure 5:
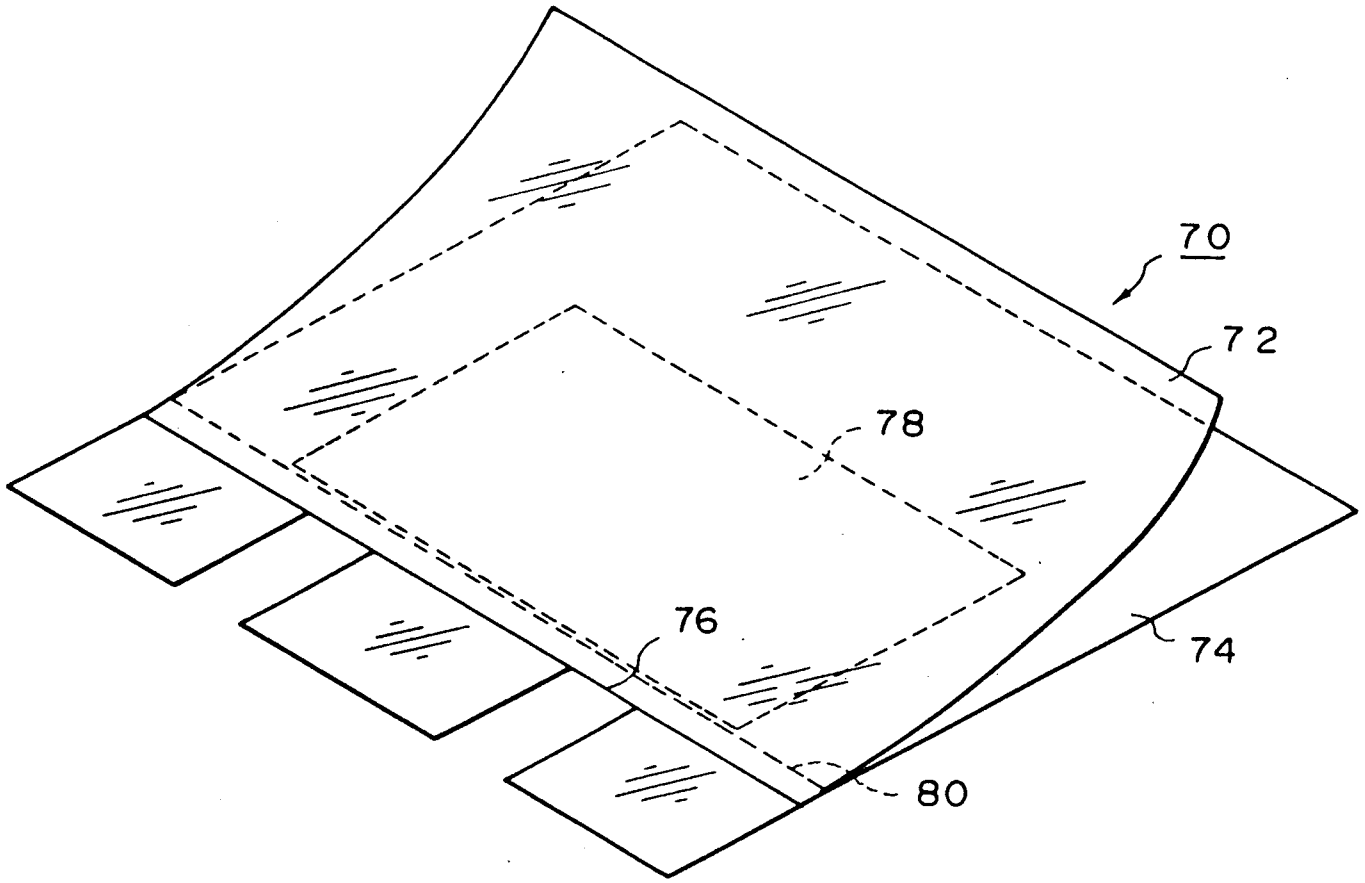
FIG. 5 is a perspective view showing the conventional carrier sheet.

Referring to FIGS. 2 and 3, an original carrier sheet 50 for a facsimile device as an instance of the image-forming apparatus comprises a rectangular transparent sheet portion 54 confronting the reading surface of an original 52, an opaque (white) sheet portion 56 having a shape substantially equal to that of the sheet portion 54 and supporting the other surface of the original 52, and a connecting portion 58 for connecting the top end edges in the delivery direction of both the sheet portions.

A notch 60 is formed in the carrier sheet 50 to extend from the top end 62 in the delivery direction of the carrier sheet 50, and this notch 60 is formed to extend beyond the entire width of the connecting portion 58 or leave the connecting portion 58 un-notched by up to 1.5 mm in the width. Accordingly, if the original 52 ordinarily having a rectangular shape is inserted between both the sheet portions 54 and 56 so that the top end side of the original 52 abuts to the rear end side of the connecting portion 58, a part (central part **52*b* in the width direction) of the top end side of the original 52 is exposed from the notch 60** in the delivery direction.

The carrier sheet 50 having the original 52 gripped therein, which is placed on an original stand 64 of a facsimile device 61, is delivered in the delivery direction H by delivery rollers 66. A lever **68*b* of an original top end detecting switch 68 abuts to the end side 52*b* of the original 52 exposed from the notch 60, not to the carrier sheet 50, to actuate the detecting switch 68, and after the lapse of a certain time (for example, 3 seconds) from the point of this detection, informations of the original 52 are read, and the carrier sheet 50 is appropriately discharged by discharge rollers 71 and 71*b*. Incidentally, reading of the original 52 is effected by an illuminating lamp 73, a mirror 75 and a sensor 77**, and the read information (optical informations) are appropriately converted to electric signals, which are transmitted to a receiver at the other end of the wire.

The notch 60 formed in the top end portion in the delivery direction of the carrier sheet may be such that the connecting portion 58 of both the sheet portions is left un-notched by up to 1.5 mm in the width direction. If the connecting portion 58 is left un-notched by more than 1.5 mm in forming the notch 60, it is apprehended that the top end of the original will not be precisely detected. In the present invention, it is preferred that the notch 60 be formed to extend beyond the connecting portion 58 while leaving no un-notched part in the width direction of the connecting portion, and it is especially preferred that the notch be formed to extend by at least 5 mm from the end side 58*a* of the connecting portion 58 (the joint of the two sheet portions). The reason is that in case of an original 52 having a certain thickness, if the above-mentioned arrangement is not adopted, it sometimes happens that the end side 52*b* of the original does not abut exactly to the end side 58*a* of the connecting portion and the original-reading position is not in agreement with the end side 58*a* of the connecting portion. Moreover, if a part of the end side of the original is exposed from the notch as described hereinafter, it is possible to use originals differing in the size.

More specifically, supposing that the width of the connecting portion is 5 to 10 mm, it is preferred that the notch should extend by 3.5 to 15 mm, especially at least about 5 mm, beyond the end edge of the connecting portion, whereby the top end side of the original is exposed from the notch in the delivery direction by the ordinary operation of inserting the original in the carrier sheet. It is preferred that the width of the notch be 20 to 50 mm, especially 30 to 40 mm. Of course, the position of the notch in the width direction in the carrier sheet is determined according to the position in the lateral direction of the original top end detecting switch of the image-forming apparatus, and in general, this position is set at the center in the width direction of the carrier sheet. Furthermore, a plurality of notches are formed in correspondence to the number of the detecting switches.

In the foregoing embodiment, the connecting portion of the two sheet portions is formed by bonding both the sheet portions through an appropriate adhesive layer. Alternatively, both the sheet portions are formed of one sheet material which is folded in two. In this case, the connecting portion is the folded portion.

As is apparent from the foregoing description, in the present invention, since a notch 60 as stated above is formed in the connecting portion on the top end in the delivery direction, it is not the top end side of the carrier sheet 50 but the top end side of the original 52 per se that is detected by the original top end detecting switch 68 of the facsimile device 61. Accordingly, reading of the original 52 is started at the predetermined position of the original and dislocation of the image-forming position on the side receiving the read informations can be prevented. Moreover, if this carrier sheet 50 is used, a change-over switch or control device for adjusting the divergence of the timing of the top end, which is necessary when the original alone is used, becomes unnecessary.

Another embodiment of the original carrier sheet is shown in FIGS. 4-A and 4-B. Referring to FIGS. 4-A and 4-B, a plurality of notches 60A and 60B are formed in the connecting portion 58 of the carrier sheet 50 so that the notches 60A and 60B extend over the entire width of the connecting portion 58. These notches correspond to the detecting switches (not shown) of the image-forming apparatus.

When a large-size AO original 52A is set in the carrier sheet 50, the original is partially exposed at the respective notches 60A and 60B, as shown in FIG. 4-A. If the carrier sheet 50 is inserted in the image-forming apparatus in this state, the respective detecting switches detect the end edge of the original at the notches 60A and 60B simultaneously, that is, at the same timing.

On the other hand, if a small-size A2 original 52B is set in the carrier sheet, the end edge of the original is exposed only at the notch 60A, as shown in FIG. 4-B, while the end edge of the original is not exposed at the notch 60B. Accordingly, the respective detecting switches show different detection timings.

Accordingly, if the detecting switches show the same detection timing, it is judged that the original is a large-size A0 original, and if the detection timings of the respective detecting switches are different, it is judged that the original is a small-size A2 original. Since this distinction is possible, either a large original or a small original can be treated by one carrier sheet, and use of a plurarity of carrier sheets according to sizes of originals becomes unnecessary. In this point, the present invention is advantageous over the conventional technique. All of the notches 60 should not absolutely be formed to extend over the entire width of the connecting portion 58, but it is sufficient if at least one notch is formed to extend over the entire width of the connecting portion.

According to the present invention, by forming a specific notch extending from the top end in the delivery direction of the carrier sheet in the connecting portion of both the sheet portions, the top end in the delivery direction of the original per se supported by both the sheet portions of the carrier sheet can be detected by the image-forming apparatus even though the carrier sheet is used for the delivery of the original, and therefore, reading of the original is started at the predetermined position of the original and divergence of the image-forming position can be prevented.

The original carrier sheet can be applied not only to the facsimile device, but also the image-forming apparatus with the automatic original delivery mechanism, shown in FIG. 1. Furthermore, if the mechanism for the delivery of a copying paper sheet and the jamming detector 45 are separated from the image-forming apparatus provided with the automatic original delivery mechanism, shown in FIG. 1, and they are connected through communication instruments, the image-forming apparatus can be used as the facsimile device. In this case, when the jam detector 45 detects jamming, an error signal is emitted to the apparatus proper and the original inserted in the apparatus proper is returned to the original position.

I claim:

1. An original carrier sheet device comprising two overlapping sheet portions, at least one of which is transparent, and a connecting portion being formed by connecting said two sheet portions at one edge side thereof, said original carrier sheet device being set in an image-forming apparatus provided with at least one original detecting means arranged in the image-forming apparatus and an automatic original delivery mechanism, in a state where the connecting portion is placed on a leading edge side of the carrier sheet device and an original is inserted between said two sheet portions, wherein at least one notch is formed on a part of a leading edge side of the connecting portion to extend over the full width of the connecting portion so that an edge portion of the inserted original is exposed to actuate the original detecting means.

2. An original carrier sheet device comprising two overlapping sheet portions at least one of which is transparent, and a connecting portion being formed by connecting two sheets at one edge side thereof, said original carrier sheet device being set in an image-forming apparatus provided with at least one original detecting means arranged in the image-forming apparatus and an automatic original delivery mechanism, in a state where the connecting portion is set on a leading edge side of the carrier sheet device and an original is inserted between said two sheet portions, wherein at least one notch is formed on a part of a leading edge side of the connecting portion to extend so that the connection portion is left un-notched by up to 1.5 mm short of the full width of the connecting portion to actuate the original detecting means.

3. An original carrier sheet device comprising two overlapping sheet portions, at least one of which is transparent, and a connecting portion being formed by folding one sheet, said original carrier sheet device being set in an image-forming apparatus provided with at least one original detecting means arranged in the image-forming apparatus and an automatic original delivery mechanism, in a state where the connecting portion is placed on a leading edge side of the carrier sheet device and an original is inserted between said two sheet portions, wherein at least one notch is formed on a part of a leading edge side of the connecting portion to extend over the full width of the connecting portion so that an edge portion of the inserted original is exposed to actuate the original detecting means.

4. An original carrier sheet device comprising two overlapping sheet portions at least one of which is transparent, and a connecting portion being formed by folding one sheet, said original carrier sheet device being set in an image-forming apparatus provided with at least one original detecting means arranged in the image-forming apparatus and an automatic original delivery mechanism, in a state where the connecting portion is set on a leading edge side of the carrier sheet device and an original is inserted between said two sheet portions, wherein at least one notch is formed on a part of a leading edge side of the connecting portion to extend so that the connecting portion is left un-notched by up to 1.5 mm short of the full width of the connecting portion to actuate the original detecting means.

* * * * *